US006337968B1

(12) United States Patent
Hayashida

(10) Patent No.: US 6,337,968 B1
(45) Date of Patent: Jan. 8, 2002

(54) CHARGE APPLY CONTROL IN AN IMAGE FORMING APPARATUS

(75) Inventor: Masatoshi Hayashida, Kanagawa-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/572,312

(22) Filed: May 18, 2000

(51) Int. Cl.[7] ..... G03G 15/16
(52) U.S. Cl. ..... 399/315; 399/66
(58) Field of Search ..... 399/315, 66, 100, 399/121, 50, 170, 308, 310, 311, 312, 313, 314, 381, 397, 398, 48, 11, 89, 115

(56) References Cited

U.S. PATENT DOCUMENTS

| | | | | | |
|---|---|---|---|---|---|
| 4,640,606 | A | * | 2/1987 | Inamoto | 399/66 |
| 5,049,939 | A | * | 9/1991 | Koichi | 399/48 |
| 5,526,106 | A | * | 6/1996 | Katsumi et al. | 399/315 |
| 5,552,872 | A | * | 9/1996 | Amemiya et al. | 399/308 |
| 5,749,039 | A | * | 5/1998 | Thomas | 399/397 |
| 5,794,097 | A | | 8/1998 | Shinkawa et al. | 399/128 |
| 6,122,460 | A | * | 9/2000 | Meece et al. | 399/31 |
| 6,173,150 | B1 | * | 1/2001 | Suzuki et al. | 399/315 |

FOREIGN PATENT DOCUMENTS

| | | |
|---|---|---|
| JP | 7-92779 | 4/1995 |
| JP | 10-78692 | 3/1998 |

* cited by examiner

*Primary Examiner*—Sophia S. Chen
*Assistant Examiner*—Hoan Tran
(74) *Attorney, Agent, or Firm*—Foley & Lardner

(57) ABSTRACT

An image forming apparatus includes an image carrier on which surface a developer image is formed, a charger to transfer a developer image on an image receiving medium from the image carrier and after transferring the developer image, give corona electric charge to a second surface of the image receiving medium being conveyed with its first surface brought in contact with the developer image on the developer image on the image carrier so as to separate the image receiving medium from the image carrier, a counter to count the number of the image receiving medium on which the developer image is transferred and formed thereon, and a voltage applying unit to apply a voltage to the charger. Further, the image forming apparatus includes a controller for increasing voltage being applied to the charger by the voltage applying unit corresponding to the increase in the number of the image receiving medium counted by the counter.

17 Claims, 5 Drawing Sheets

| COUNT OF NUMBER OF COPIES | PEELING CHARGER | |
|---|---|---|
| [NUMBER OF SHEETS] | CONTROL VOLTAGE [V] | AC VOLTAGE [KV] |
| ~10,000 | 3.00 | 4.27 |
| ~20,000 | 3.06 | 4.31 |
| ~30,000 | 3.12 | 4.36 |
| ~40,000 | 3.18 | 4.40 |
| ~50,000 | 3.24 | 4.45 |
| ~60,000 | 3.30 | 4.50 |
| ~70,000 | 3.36 | 4.55 |
| ~80,000 | 3.42 | 4.60 |
| ~90,000 | 3.48 | 4.64 |
| ~100,000 | 3.54 | 4.69 |
| ~110,000 | 3.60 | 4.74 |
| ~120,000 | 3.66 | 4.79 |
| ~130,000 | 3.72 | 4.83 |
| ~140,000 | 3.78 | 4.88 |
| ~150,000 | 3.84 | 4.93 |

CHARGE APPLY CONTROL IN AN IMAGE FORMING APPARATUS

BACKGROUND OF THE INVENTION

1. Field of the Invention

The present invention relates to an image forming apparatus which is capable of forming high quality of images without causing the jamming of sheets of paper during its conveyance and an image forming method.

2. Description of the Related Art

In an image forming apparatus which is widely used these days, a document image to be copied is exposed on the image carrier after it is electrified to the negative potential. As a result of this exposure, the electric charge on the exposed surface of the image carrier in the background area is neutralized and an electrostatic latent image corresponding to the image area of the document is formed on the surface of the image carrier. This electrostatic latent image formed on the surface of the image carrier is then developed by a developing toner to a visible image. This toner image is transferred on a sheet of paper in the transferring process and then, the sheet of paper with the toner image transferred is separated from the image carrier in the peeling process. The toner image on the separated sheet of paper is heated or pressurized and fixed permanently thereon. After a sheet of paper is separated, the residual toner left on the surface of the image carrier is removed by a cleaner.

In a conventional image forming apparatus using transferring and peeling chargers as described above, in order to satisfactorily transfer a toner image on a sheet of paper and peel off the paper from an image carrier for a long period, an image forming apparatus equipped with an automatic cleaning unit for automatically cleaning wires of transferring and peeling chargers was disclosed in Japanese Laid Open Patent No. 07-92779. The purpose of this automatic cleaning unit is to prevent the paper jamming and an image from becoming defective that are caused from the contamination of the wires of the transferring and peeling chargers resulting from the use of the image forming apparatus for a long period.

In a conventional image forming apparatus which uses transferring and peeling chargers, the wires of the transferring and peeling chargers are contaminated with toner and paper powder floating in the image forming apparatus and adhered to the surfaces of the wires with the increase in the number of copies. Corona discharge current for the transfer and peeling drops gradually from an initial set value when the charger wires are contaminated. When corona discharge current drops, the transfer of a toner image from an image carrier and separation of a sheet of paper from the image carrier, which are the basic functions of the transferring and peeling chargers will become worse.

In particular, as shown in FIG. 2, the above-mentioned problems tend to occur in an image forming .apparatus of such type that sheets of paper are ejected in its main body. In other words, in the transfer and peeling areas, a sheet of paper is conveyed upward from the lower part to the upper part as shown in FIG. 2 and the force of gravity of the leading edge of this sheet of paper cannot be used when separating it from the image carrier. The image forming apparatus shown in FIG. 2 has no margin in the condition of peeling corona current condition for achieving the stabilized paper separating performance when compared with the paper separation performance of the paper conveyance in the horizontal direction in the image forming apparatus shown in FIG. 1. In order to solve these problems, an image forming apparatus equipped with a cleaning unit for automatically cleaning the surface of the charger wires was disclosed in the above-mentioned Japanese Laid Open Patent No. 07-92779. However, this automatic cleaning unit requires a wire cleaning member, a driving motor for operating the cleaning member, etc. and this system will become very expensive. Further, in order to minimize the required cost, an image forming apparatus that operates a wire cleaning unit manually was also disclosed in Japanese Laid Open Patent No. 10-78692. However, differing from the automatic cleaning unit, this type of cleaning unit is not able to clean a wire periodically and also not able to obtain sufficient reliability for the wire cleaning level and its maintenance is troublesome. In addition, as the image forming apparatus must be stopped whenever the wire is cleaned manually, there was such a problem that a downtime of the apparatus becomes long.

SUMMARY OF THE INVENTION

It is an object of the present invention to provide an image forming apparatus and an image forming method which are able to perform the peeling of an image receiving medium such as a sheet of paper from an image carrier after transferring an image formed on an image carrier on the image receiving medium even if a corona wire of a peeling charger, which acts to peel off an image receiving medium from the image carrier, is contaminated as a result of the use for a long period and to perform the high quality image formation.

According to the present invention, there is provided an image forming apparatus comprising image forming means for forming a developer image on the surface of an image carrier; charge means for transferring the developer image from the image carrier on an image receiving medium and after this image transfer, giving electric charge to the image receiving medium so that it is separated from the image carrier; counter means for counting the number of image formations by the image forming means; voltage applying means unit for applying a voltage to the charge means; and control means for controlling voltage applied to the charge means by the voltage applying means so as to vary it according to the number of image formations counted by the counter means.

Further, according to the present invention, there is provided an image forming method comprising the steps of forming a developer image on the surface of an image carrier; transferring the developer image on an image receiving medium from the image carrier and after transferring the developer image, giving electric charge to the image receiving medium by a charger so as to separate the image receiving medium from the image carrier; counting the number of developer image formations; applying a voltage to the charger; and controlling the voltage applied to the charger so as to vary it according to the number of counted developer image formations.

DETAILED DESCRIPTION OF THE PREFERRED EMBODIMENTS

Figure 1:
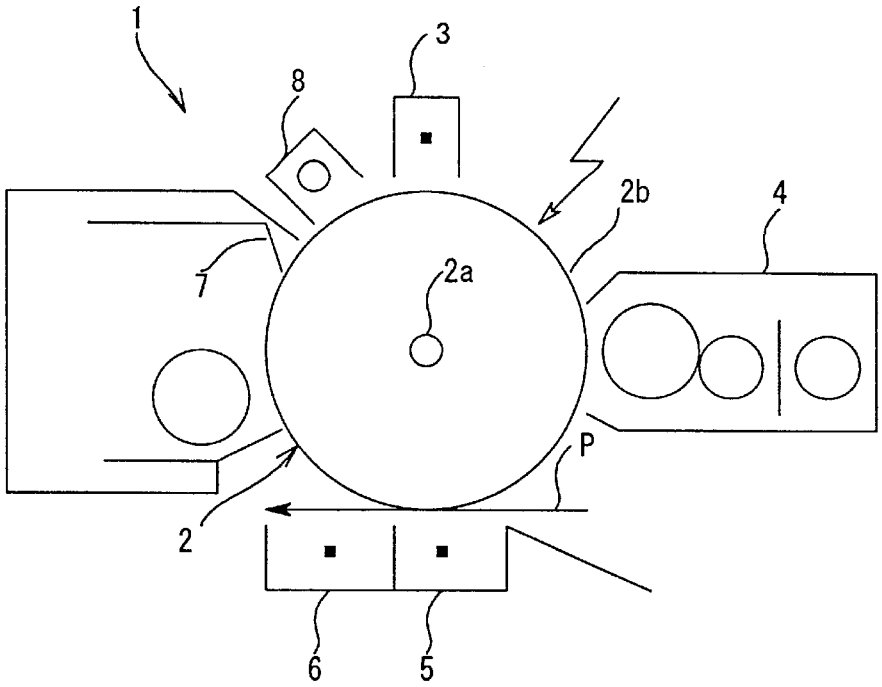
FIG. 1 is a diagram schematically showing a copying machine of horizontal paper conveying type.
Figure 2:
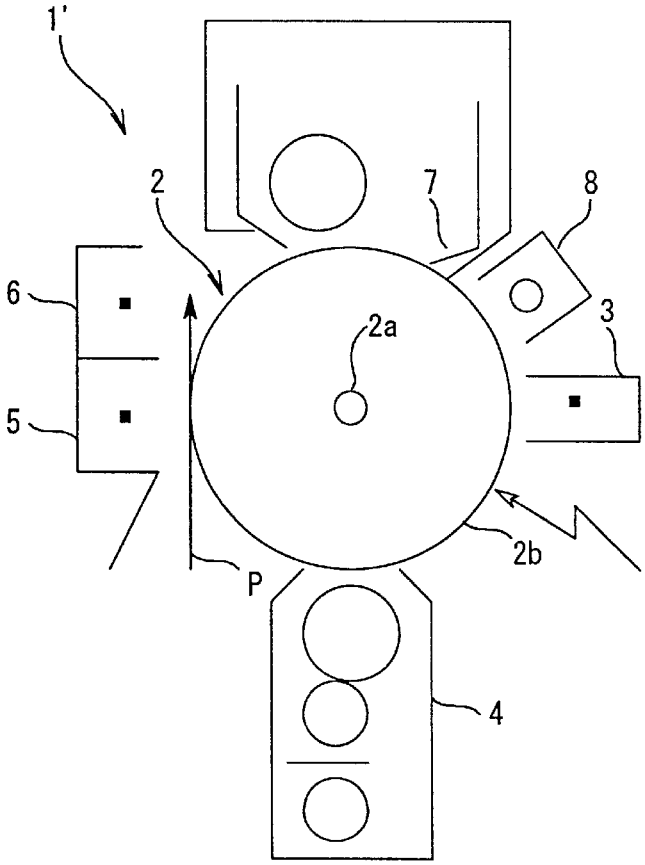
FIG. 2 is a diagram schematically showing a copying machine of vertical paper conveying type.

FIG. 1 and FIG. 2 schematically show a copying machine that is as an image forming apparatus applied with the present invention. In FIG. 1, a copying machine 1 has a photosensitive drum 2 that is an image carrier basically comprising a conductive supporting body, a photoconductive layer and an insulation layer at almost its center. The photosensitive drum 2 has a rotary shaft 2*a* at its center and is rotated with the rotation of this rotary shaft 2*a*. Around the photosensitive drum 2, there are arranged a main charger 3 for uniformly electrifying the surface 2*b* of the photosensitive drum 2 (hereinafter, simply referred to as the drum surface 2*b*) by providing electric charge to the drum surface 2*b*, an exposing device (not shown), developing unit 4, a transferring charger 5, a peeling charger 6, a cleaning blade 7 and a charge eliminating lamp 8 sequentially along the rotating direction of the photosensitive drum 2.

The main charger 3 uniformly electrifies the drum surface 2*b* by applying electric charge to the drum surface 2*b*.

The exposing device exposes the drum surface 2*b* according to an image signal and forms an electrostatic latent image thereon.

The developing unit 4 houses two-component developing agent comprising electrified toner and carrier and makes an electrostatic latent image visible by feeding the charged toner to the electrostatic latent image formed on the drum surface 2*b*.

The transferring charger 5 is arranged at a transferring position almost just below the photosensitive drum 2 facing the drum surface 2*b* and transfers a toner image formed or the drum surface 2*b* onto an image receiving medium, for instance, a sheet of paper P by giving electric charge (positive electric charge) by the corona discharge to the back of the paper P, that is an image receiving medium passing the transferring position.

The peeling charger 6 peels off the sheet of paper P with a toner image transferred from the dram surface 2*b* by giving electric charge of polarity that is reverse to the polarity at the time of transfer (negative electric charge) by the corona discharge.

The cleaning blade 7 scrapes the toner remained on the drum surface 2*b*.

The charge eliminating lamp 8 eliminates the electric charge remained on the drum surface 2*b* by applying a charge eliminating light to the drum surface 2*b*.

The photosensitive drum 2 is rotated at the predetermined peripheral velocity, the drum surface 2*b* is electrified to the predetermined potential by the main charger 3, the charged dram surface 2*b* is exposed by the exposing device (not shown) and an electrostatic latent image is formed on the drum surface 2*b*. Toner is supplied from the developing unit 4 to this electrostatic latent image, which is then developed and a toner image is formed on the drum surface 2*b*.

The toner image thus developed on the drum surface 2*b* is conveyed to the transferring position by the rotation of the photosensitive drum 2, and is transferred on the sheet of paper P by the transferring charger 5.

The paper P with the toner image transferred thereon is peeled off from the drum surface 2*b* by the peeling charger 6 and conveyed to the fixing device (not shown) provided at the downstream of the transferring position.

On the other hand, the residual toner remained on the drum surface 2*b* passed the transferring position is scraped off by the cleaning blade 7. Further, preparing for the next image forming process, the charge eliminating light is applied to the drum surface 2*b* by the charge eliminating lamp 8 and the electric charge left on the drum surface 2*b* is eliminated.

In the copying machine 1 shown in FIG. 1, the main charger 3, developing unit 4, transferring charger 5, peeling charger 6, cleaning blade 7 and charge eliminating lamp 8 are arranged around the photosensitive drum 2 so that the sheet of paper P is conveyed in the horizontal direction.

Further, in a copying machine 1' shown in FIG. 2, the main charger 3, developing unit 4, transferring charger 5, peeling charger 6, cleaning blade 7 and charge eliminating lamp 8 are arranged around the photosensitive drum 2 so that a paper P is conveyed in the vertical direction. Further, in the structure of the copying machine 1' shown in FIG. 2, the main charger 3, developing unit 4, transferring charger 5, peeling charger 6, cleaning blade 7 and charge eliminating lamp 8 are arranged around the photosensitive drum 2 by shifting them by 90 degree from the copying machine shown in FIG. 1, and respective units are almost in the same structure as those shown in FIG. 1. Therefore, they are assigned with the same reference numerals as in FIG. 1 and the explanations thereof will be omitted.

Further, as a paper P is conveyed from the lower part to the upper part of the copying machine as shown in FIG. 2, the transfer charger 5 is arranged at the lower part and the peeling charger 6 is provided above the transfer charger 5. The photosensitive drum 2 in a diameter 60 mm is used by considering its life.

Figure 3:
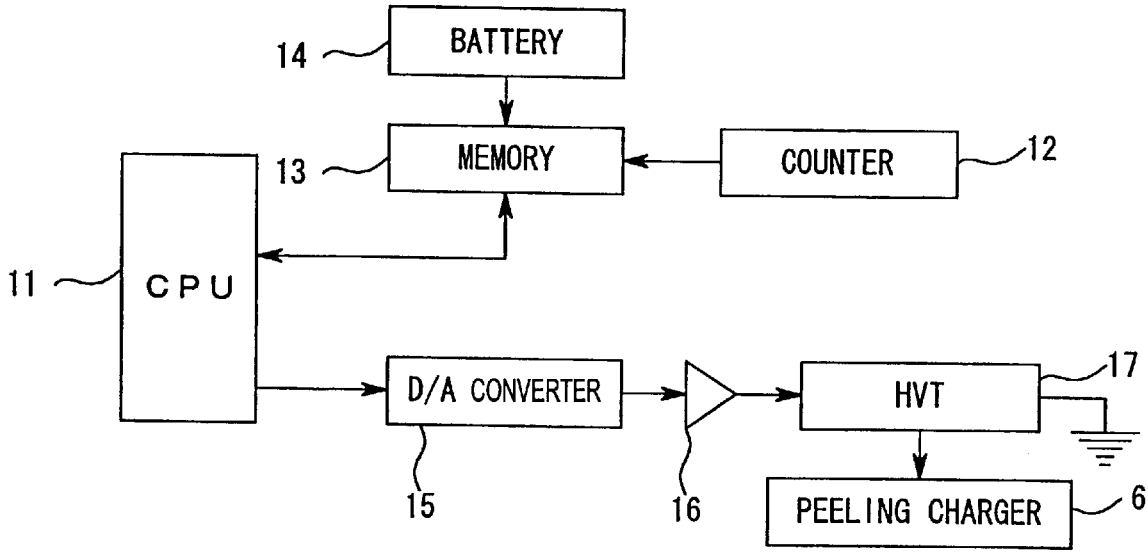
FIG. 3 is a block diagram showing the control of voltage feeding to a peeling charger in an image forming apparatus of the present invention.

FIG. 3 is a block diagram showing the circuit configuration in the image forming apparatus of the present invention. The main body of the image forming apparatus is equipped with a counter 12 for transmitting, for instance, data of the number of sheets to be copied. The counter 12 is connected to a memory 13 so that this data of the number of sheets is stored in the memory 13. The memory 13 is connected with a battery 14 that is to back up the data stored in the memory 13. The memory 13 is connected to a CPU 11 for exchanging data with the CPU 11. A D/A converter 15 is connected to the CPU 11 for converting digital signals transmitted from the CPU 11 into analog signals. Further, an amplifier 16 is connected to the D/A converter for amplifying signals transmitted from the D/A converter 15. The output of the amplifier 16 is connected to a high-voltage transformer 17 which is connected to the peeling charger 6 so that high-voltage power from this high-voltage transformer 17 is supplied to the peeling charger 6.

Data on the number of sheets transmitted from the memory 13 are processed in the CPU 11 and the processed data are fed back to the high-voltage transformer 17 via the D/A converter 15 and the amplifier 16. That is, the output of the high-voltage transformer 17 is controlled to close the initial corona discharge current so as to approximate it to the output for peeling corresponding to the number of sheets to be copied.

Figures 4, 5:
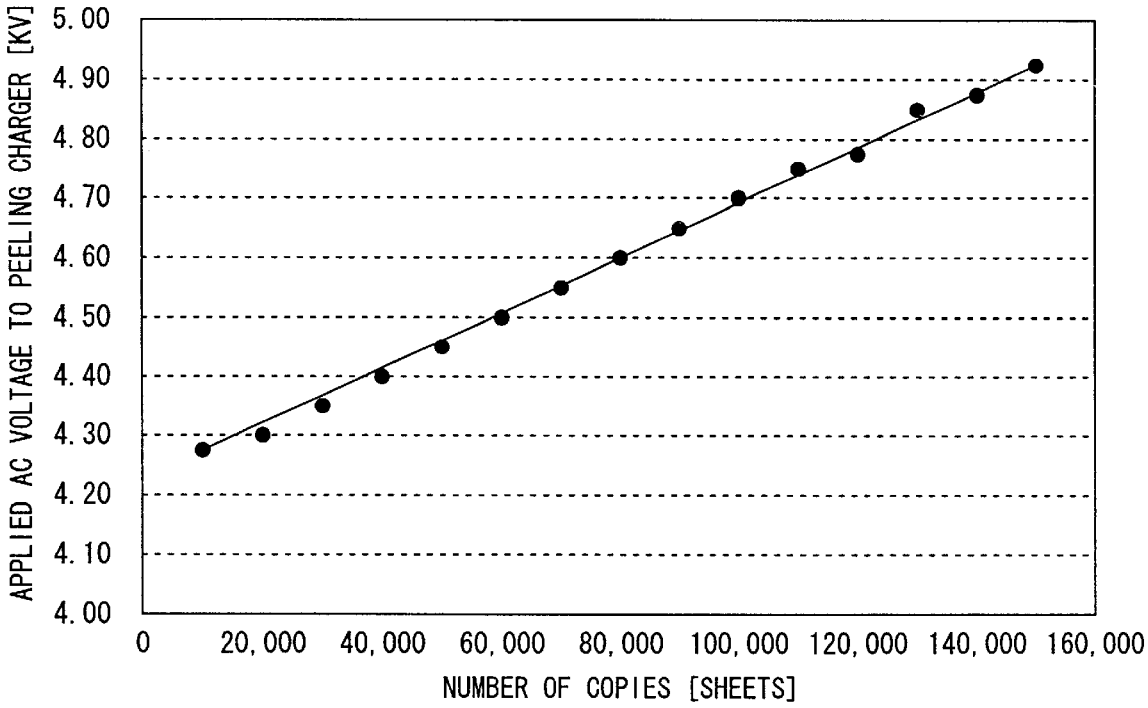
FIG. 4 is a diagram showing an example of a program in the voltage feed control shown in FIG. 3.
FIG. 5 is a graph showing an example of a program shown in FIG. 4.

If the voltage applied to the peeling charger 6 is not controlled, the corona discharge current of the peeling charger 6 decreases gradually in connection with the increase in the number of image formations. To prevent (or at least mitigate) the corona discharge current of the peeling charger 6 from decreasing, the CPU 11 has been programmed to control the output voltage of the high-voltage transformer 17 so as to increase it as shown in FIG. 4 and FIG. 5. By controlling the output voltage of the high-voltage transformer 17, the corona discharge current of the peeling charger 6 approximates to the initial state even if the number of image formations increase.

Figure 6:
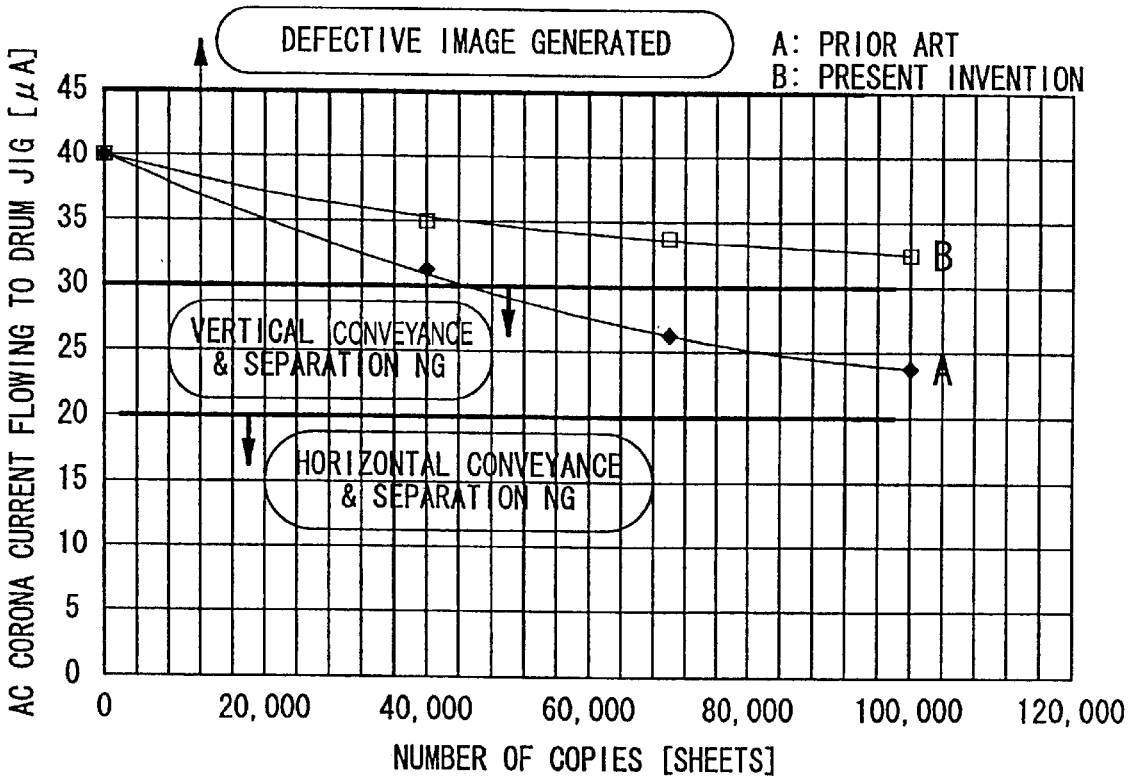
FIG. 6 is a graph showing a paper separation performance with the increase in the number of copies by comparing a conventional technology with the present invention.

Here, the corona current condition of the peeling charger to the paper separation in the copying machine 1' to convey a sheet of paper in the vertical direction shown in FIG. 2 will be explained FIG. 6 shows the relation between the peeling AC corona current and the paper separation recorded on an electrification recorder used in the tests of the present invention. The corona current flowing to the peeling charger was measured using the corona current flowing into an aluminum made jig in a diameter 60 mm and axial length 50 mm that is the same as the photosensitive drum 2. First, the initially set AC corona current is 40 $\mu$A. As the result, under the condition wherein the AC corona current flowing to the peeling charger is 30 $\mu$A or below, the paper separation from an aluminum made jig (approximate to the photosensitive drum) becomes unstable and the paper jamming is caused. Therefore, it is easily considered that the initial current set at higher than, for instance, 50 $\mu$A is preferable. However, at the condition of the current at above 45 $\mu$A as shown in FIG. 6, there is caused such a problem that a toner image transferred on a sheet of paper is adhered to the photosensitive drum again. Accordingly, the AC corona current flowing to the peeling charger cannot be set at higher than 45 $\mu$A.

That is, it is necessary to set AC corona current at 40 $\mu$A initially and control it so that it drops gradually with the increase of the number of copies in order to secure the good paper separating performance until the consumable parts exchange cycle.

Further, the consumable parts are such parts as a cleaner blade, a cleaner of the fixing unit, the photosensitive drum, a developing agent, wires of the chargers, etc.

Further, in the case of the copying machine 1 that is of horizontally paper conveying type as shown in FIG. 1, under the condition of AC corona current flowing to the peeling charger at 20 $\mu$A or below the paper separation from the photosensitive drum becomes unstable and the paper jamming is caused as shown in FIG. 6.

In FIG. 6, the number of copies are shown on the axis of abscissas and AC corona current flowing to an aluminum drum jig is shown on the axis of ordinates. The solid line A shows the declining history of the corona current flowing to the aluminum drum jig in a conventional technology when the control of the present invention was not applied. The solid line B shows the history of the corona current flowing to the aluminum drum jig when the control of the present invention was applied.

When the sheet of paper P is conveyed in the vertical direction without the control of the present invention as shown in FIG. 2, at the time when 44,000 sheets of paper were copied, 30 $\mu$A corona current required for separating paper cannot he obtained, the vertical conveying and separation become worse and the paper jamming tends to occur.

On the contrary, the solid line B shows the changes in AC corona current flowing to the aluminum drum jig when the control of the present invention was applied. The AC corona current is so controlled that it does not drop to a low level to cause the defective paper separation even when a target of copying of 100,000 sheets is reached and therefore, a problem that occurs when the current is not controlled as shown by the solid line A is not caused.

The contents of this control are as shown in FIG. 5 and FIG. 6. Every time when 10,000 sheets of paper are counted by the counter 12, AC current flowing to the aluminum drum jig is increased by 1 $\mu$A up to 150,000 sheets of paper. To increase AC current by 1 $\mu$A, vary AC voltage [kV] to be supplied to the peeling charger 6 from the high-voltage transformer 17 by selecting control voltage [V] provided for in the high-voltage transformer 17. For instance, when the AC voltage supplied to the peeling charger 6 is controlled to 4.27 [kV] by selecting the control voltage 3.00 [V] when the number of sheets of paper is 10,000 sheets, to 4.69 [kV] by selecting the control voltage 3.54 [V] when the number of sheets of paper is 100,000 sheets, and to 4.93 [kV] by selecting the control voltage 3.84 [V] when the number of sheets of paper is 150,000 sheets, it becomes possible to stabilize the paper separation.

Figure 7:
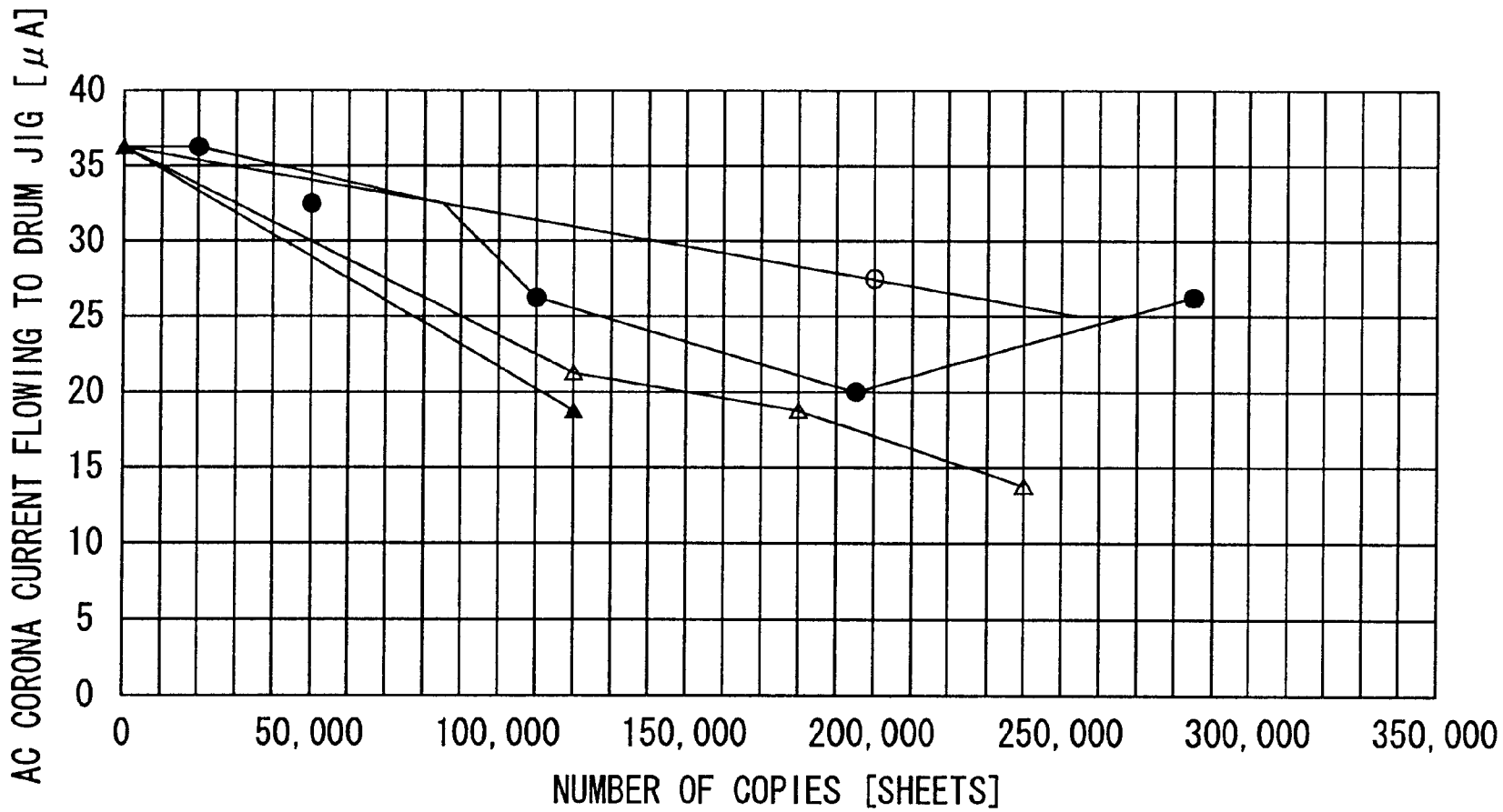
FIG. 7 is a graph showing dispersion of AC corona current flowing to a drum jig with the increase in the number of copies.

Further, regarding a controlled variable (increasing volume of corona current), it is preferable that a controlled variable should be decided so that the AC corona current flowing to the peeling charger after reaching a target number of copies becomes the same as the initial corona current value. However, as a result of the examination made on the declining history of the AC current flowing to the peeling charger including variance, it was revealed that the current declination is not always the same but is variable by about 30% in terms of the width of deflection as shown in FIG. 7. Accordingly, when a controlled variable is adopted so as to maintain the initial value corresponding to the worst condition of the corona current drop, the excessive control will result when the current drop is inversely the minimum. As a result, the corona current exceeds the settable upper limit of the corona current flowing to the peeling charger and a defective image is generated. Therefore, taking a variance of the corona current drop into consideration, it is desirable as the control stance to design a controlled variable so as not to exceed the worst initially set current as shown in this embodiment. Further, as the target for the maintenance cycle of the image forming apparatus in this embodiment is 100,000 sheets, basically there will be no problem up to 100,000 sheets when controlling the current flowing to the aluminum drum jig. However, by considering a case where the image forming apparatus is continuously used without the maintenance after copying 100,000 sheets, it has been so designed that it is possible to control the copying of paper up to 1.5 times of the specified number of sheets in this embodiment.

When consumable parts are exchanged at the number of copies 100,000, the wire of the peeling charger should be exchanged with a new wire when 100,000 sheets are reached. At the time when the wire was exchanged, the voltage applied to the peeling charger is higher than the initial voltage applied for peeling sheets of paper and therefore, the corona current flowing to sheets of paper becomes too large inversely. To cope with this problem, in the image forming apparatus of the present invention, a set value of voltage supplied to the peeling charger can be returned to the initial state simultaneously with the wire exchange. Thus, it becomes possible to apply the proper current to the peeling charger even when its wire is a new wire.

According to the present invention, it is possible to secure a corona discharge current condition in the peeling charger, of which paper separation performance from the photosensitive drum is satisfactory even when the number of copying sheets are increased as shown by the solid line B in FIG. 6.

In this embodiment, the control of corona current flowing to the drum jig has been explained from the viewpoint of the stabilized paper separation from the photosensitive drum. However, regarding the control of the corona current to the transferring charger, the similar control is also possible from the aspect of image characteristic.

As described above in detail, according to the present invention, it is not required to clean the wire of the peeling charger at least until the time when the consumable parts are exchanged and a wire cleaning member and cleaning driver, etc. are not required. As a result, it is possible to obtain stabilized paper conveying reliability and high quality image for an extended period at a very cheap cost.

What is claimed is:

1. An image forming apparatus comprising:

image forming means for forming a developer image on the surface of an image carrier;

charge means for transferring the developer image from the image carrier on an image receiving medium and after this image transfer, giving electric charge to the image receiving medium so that it is separated from the image carrier;

counter means for counting the number of image formations by the image forming means;

voltage applying means unit for applying a voltage to the charge means; and control means for controlling voltage applied to the charge means by the voltage applying means so as to vary it according to the number of image formations counted by the counter means.

2. An image forming apparatus according to claim 1, wherein the control means controls the voltage applied to the charge means by the voltage applying means so as to increase it corresponding to the increase in the number of image formations counted by the counter means.

3. An image forming apparatus according to claim 1, wherein the charge means includes a peeling charger.

4. An image forming apparatus according to claim 1, wherein the charge means includes a transferring charger.

5. An image forming apparatus according to claim 1, further comprising:

conveying means for conveying the image receiving medium while bringing it in contact with the image carrier, the conveying means forms a substantially vertical conveying path so as to convey the image receiving medium from the lower part to the upper part.

6. An image forming apparatus according to claim 1, wherein the control means includes means for resetting voltage applied to the charge means by the voltage applying means to an initial set value when such consumable parts as a charge wire comprising the charge means is exchanged.

7. An image forming apparatus according to claim 1, wherein the control means varies the voltage applied to the charge means according to the number of image formations counted by the counter means while the charge means is in operation.

8. An image forming apparatus comprising:

an image forming unit for forming a developer image on the surface of an image carrier;

a charger for transferring the developer image onto an image receiving medium from the image carrier and after transferring the image, giving electric charge to the image receiving medium so as to separate it from the image carrier;

a counter for counting the number of image formations by the image forming unit;

a voltage applying source for applying a voltage to the charger; and a controller for controlling the voltage applied to the charger from the voltage applying source so as to change it according to the number of image formations counted by the counter.

9. An image forming apparatus according to claim 8, wherein the controller controls the voltage applied to the charger from the voltage applying source so as to increase it corresponding to the increase in the number of counts by the counter.

10. An image forming apparatus according to claim 8, wherein the charger includes a peeling charger.

11. An image forming apparatus according to claim 8, wherein the charger includes a transferring charger.

12. An image forming apparatus according to claim 8, further comprising:

a conveyor belt for conveying the image receiving medium bring it to contact with the image carrier, the conveyor belt forms a substantially vertical conveying path so as to convey the image receiving medium from the lower part to the upper part.

13. An image forming apparatus according to claim 8, wherein the controller includes means for resetting the voltage applied to the charger by the voltage applying source to an initial value when consumable parts are exchanged with new parts.

14. An image forming apparatus according to claim 8, wherein the controller changes the voltage applied to the charger according to the number of image formations counted by the counter while the charger is in operation.

15. An image forming method comprising the steps of:

forming a developer image on the surface of an image carrier;

transferring the developer image on an image receiving medium from the image carrier and after transferring the developer image, giving electric charge to the image receiving medium by a charger so as to separate the image receiving medium from the image carrier;

counting the number of developer image formations;

applying a voltage to the charger; and controlling the voltage applied to the charger so as to vary it according to the number of counted developer image formations.

16. An image forming method according to claim 15, wherein the controlling step controls voltage applied to the charger so as to increase it corresponding to the increase in the number of counted developer image formations.

17. An image forming method according to claim 15, wherein the voltage applied to the charger is varied according to the number of counted developer image formations while the charger is in operation.

* * * * *